US008099886B2

(12) United States Patent
Ellerton

(10) Patent No.: US 8,099,886 B2
(45) Date of Patent: Jan. 24, 2012

(54) AIRPORT GUIDANCE SIGN ILLUMINATED WITH CYLINDRICAL LED ARRAYS

(75) Inventor: Andrew B. Ellerton, Syracuse, NY (US)

(73) Assignee: Airfield Guidance Sign Manufacturers, Inc., Manlius, NY (US)

( * ) Notice: Subject to any disclaimer, the term of this patent is extended or adjusted under 35 U.S.C. 154(b) by 74 days.

(21) Appl. No.: 12/533,018

(22) Filed: Jul. 31, 2009

(65) Prior Publication Data

US 2011/0023338 A1 Feb. 3, 2011

(51) Int. Cl.
*G09F 13/04* (2006.01)

(52) U.S. Cl. ..... 40/564; 40/217; 40/572; 362/249.02; 362/812

(58) Field of Classification Search ..... 40/564, 40/217, 572
See application file for complete search history.

(56) References Cited

U.S. PATENT DOCUMENTS 5,806,965 A * 9/1998 Deese ..... 362/249.04
6,119,055 A 9/2000 Richman
6,946,975 B2 9/2005 Hansler et al.
7,134,764 B1 * 11/2006 Bieberdorf ..... 362/183
7,382,252 B2 * 6/2008 Brannon ..... 340/569
2004/0037088 A1 * 2/2004 English et al. ..... 362/545
2007/0204496 A1 * 9/2007 Ellerton ..... 40/564
2008/0104870 A1 * 5/2008 Alden ..... 40/422
2008/0247161 A1 * 10/2008 Hulsey et al. ..... 362/227

* cited by examiner

*Primary Examiner* — Joanne Silbermann
*Assistant Examiner* — Kristina N Junge
(74) *Attorney, Agent, or Firm* — Bernhard P. Molldrem, Jr.

(57) ABSTRACT

An improved illuminated airfield guidance sign of the type used for marking ground traffic routes on runways and taxiways employs LED-based lamps for even illumination of the legend panels. The lamps each employ an array of white LEDs mounted on a generally cylindrical turret, and oriented with the turret axis horizontal, so that the LEDs aim their beams up, down, or laterally, and not towards the legend panels. The illumination has to bounce at least once on an interior reflective surface before reaching the legend panels. These can receive power from storage batteries that are charged from solar panels or wind turbines, with back-up power coming from the standard runway-taxiway power.

18 Claims, 3 Drawing Sheets

AIRPORT GUIDANCE SIGN ILLUMINATED WITH CYLINDRICAL LED ARRAYS

BACKGROUND OF THE INVENTION

The present invention relates to illuminated airfield signs of the type used for marking ground traffic routes on runways and taxiways. The invention is more particularly concerned with an improved airport guidance sign having reduced power consumption, greater reliability and more even illumination across its legend panel(s) than the guidance signs of the prior art.

Illuminated guidance signs are commonly used at airports to identify runways and taxiways and provide ground route marking information for air crews. These guidance signs have transparent or translucent legend panels supported in a frame or case, with the case being supported on legs that provide a minimum ground clearance. Airport runway and taxiway guidance signs are an essential element of airport operation and safety, and are essential for managing ground traffic for airplanes and for maintenance personnel. The sign needs to be clearly visible at all hours, both by air crews and by maintenance crews, and non-dimming, so the illumination needs to be even so that the message on the sign can be clearly distinguished in all ambient lighting conditions and at all viewing angles.

The standards for airport guidance signs in the United States are established by the Federal Aviation Administration. The FAA requires a wind load and frangibility test to ensure that the sign will perform its function under severe wind conditions, but can break off under conditions of extreme force, for example if an aircraft rolls into or over the guidance sign. A frangible connector employed in the mounts for the guidance signs to provide a safe failure mode for the signs so that the danger to the aircraft is minimized. The FAA also requires that the guidance sign meets specifications for photometry, and power source specifications when drawing power from connections to the airfield circuit, i.e., runway and taxiway power.

In double-width, multiple-width, or larger guidance signs, and in those that have curved legend panels, the internal support structure can block the light from the guidance sign lamps, and can create undesirable shadows and bright spots in the legend panels, and this can affect their readability adversely. There have been some attempts to remedy this unevenness of lighting by including additional reflective structure within the frame of the guidance sign. One such attempt is discussed in Hansler et al. U.S. Pat. No. 6,946,975. In the approach that is discussed in that reference, there is a multiple-element light source, with the lamps producing downwardly directed beams. There are prism refractors disposed at the base of the sign, with V-shaped grooves, which are intended to diffuse the incident light so that it is more or less even when it reaches the guidance sign legend panels. While this rather complex design does improve the evenness of lighting somewhat, it does not provide even lighting across the entire panel. Moreover, the power consumption is of that design is rather high.

OBJECTS AND SUMMARY OF THE INVENTION

Accordingly, it is an object of this invention to provide an illuminated guidance sign with a lamp arrangement that creates even lighting across the legend panels of the sign, and which avoids the drawback of the prior art.

Another object is to provide a guidance sign with evenly illuminated legend panels, and at the same time with reduced power consumption.

It is yet another object to provide for even illumination of guidance signs that employ either flat or curved legend panels.

It is a further object to provide an illuminated guidance sign that can be powered by stored solar-generated power, or stored wind-generated power, but which can switch over to the normal runway-taxiway power at times when the stored solar-generated or wind-generated energy is insufficient for sign operation.

In accordance with an aspect of the present invention, an illuminated airport guidance sign includes a pair of translucent or transparent legend panels formed of a sheet of a sturdy rigid material, e.g., a clear or translucent acrylic, and a sign frame that supports the legend panels in a symmetric oppositely-facing orientation. The frame has a base that closes off the bottom of the sign; a top cover that closes off a top of the sign; and end portions that close off ends of the sign. The panels and frame form a hollow interior, in which a plurality of lamps are supported on structure between the pair of legend panels. Electrical power and control equipment disposed within the guidance sign provide electrical power to the lamps so as to produce even illumination that falls onto the panels and passes through them to make the message clearly visible. The are support legs supporting the base of the guidance sign upon a support surface alongside the runway or taxiway.

The guidance sign of this invention incorporates the improvement in which each of lamps is formed as an array of white LEDs supported on a cylindrical turret. These lamps are constructed so that the LEDs emit light in directions that are radially outward in respect to the central axis of the cylindrical turret. Then each multiple LED lamp is mounted on the support structure such that the cylindrical turret axis is horizontal and disposed in the direction that is generally towards the associated pair of legend panels. In this fashion, the array of LEDs emits light in the directions that is generally parallel to the legend panels, that is, towards the base and top panel, and towards the end panels, but not directly at the guidance sign legend panels. The LED arrays direct the light up, down, and parallel to the panels, so that the light bounces at least once on the internal structure before reaching the panel. A preferred guidance sign employs four LED arrays, i.e., two pairs of two, in the smaller signs. The larger signs can employ multiple LED arrays per sign module. Thus, the light from said LEDs reflects off at least one interior surface of the frame of the sign before being incident upon one of said panels. Each of the legend panels has an interior surface that has a reflective coating, and the interior portions of the sign frame also are provided with a highly reflective coating, to ensure maximal bouncing of light within the sign. The multiple reflections of the illuminating light within the guidance sign means that there are no bright spots and no dark spots over the length and height of the legend panel, and that the light impinges from all angles so that the sign is clearly visible at all angles of view.

These LED lamps have a much smaller power draw than the incandescent lamps. This makes it possible to power the signs with a solar array and battery, or a small wind turbine and battery, using the standard runway/taxiway electrical system to power the signs only when the solar and battery system or wind turbine and battery system does not have enough charge.

Preferably, each of the lamps is formed with a flat circuit board, with means for mounting onto the support structure, and with the cylindrical turret disposed on one side of the circuit board so that it projects out towards one of the legend panels. In a preferred arrangement, there are two pairs of these lamps, with two oriented towards the one panel and two towards the other. The array of LEDs on the turret can be configured as a plurality of axial rows of LEDs, with the rows being arranged at successive predetermined angles around the axis of the turret. In a preferred arrangement, there are fifty-six LEDs, in fourteen rows of four, each row angled at about 25.7 degrees from the next. The LEDs are most favorably arranged so they are electrically connected in groups of LEDs in which each LED of each group is in a different row. Then, in the case of a failure of a group (in which the LEDs thereof are extinguished and go dark) the dark LEDs of that group are distributed at different angular positions about the axis of the turret. The lamp can also be arranged so that when some predetermined number of these groups fail, e.g., four groups, then the entire lamp goes off, so it can be replaced. An additional LED placed on the circuit board lights up when there is a problem, such as a partial failure of the LED array of the lamp. This can be a colored LED, e.g., red, and allows a maintenance technician to identify a problem lamp, despite the brightness of the remaining LEDs of the lamp.

Some preferable features of the LED arrays include having the device connected into fourteen groups of four LEDs, not all the LEDs of each group at the same angular position, and having the device shut down when 25% of the LEDs were not lighting up. There is also a red (or green) LED on the device which comes on in the case of a failure or partial failure, to indicate which unit needs to be replaced.

The electrical power means for the guidance sign preferably includes a storage battery within the frame and circuitry for providing electrical power to the LED lamps from the storage battery. A solar panel or a small wind turbine generator disposed outside the sign or onto the sign, but in the near vicinity of the sign, provides power to charge the battery. There is circuitry that couples the solar panel to said rechargeable battery for charging the battery during daylight hours. A wind powered generator would not be limited to daylight hours. Also, power conductors carry runway-taxiway power to the guidance sign for back-up, and the sign includes switching circuitry, with means to detect the amount of charge on the storage battery, as well as means to switch from the rechargeable battery to the runway-taxiway power when the electrical charge falls below some predetermined threshold. This can also be used for charging the battery on days when it is too cloudy or dark for the solar panel to provide sufficient electrical power for that purpose (or with the wind turbine, when there is insufficient wind).

Should the battery power become insufficient for the sign to maintain photometric requirements according to the applicable FAA directive, the sign will switch its power source to draw from its connection to the airfield circuit. The guidance sign of this invention has the benefits that it imposes a near-zero load on the runway and taxiway power circuit (CCR) so long as battery power is sufficient. In the case of circuits powering only signs, the CCR could alternatively be controlled by a communications interface between the signs and the CCR, which would energize the CCR when the battery in any sign on the circuit had too low a charge, and de-energize the CCR when the battery on the circuit having the least charge became charged by the CCR to a predetermined sufficient level. The sign turns on and off under control of the runway and taxiway power circuit, as a solely CCR-powered device would do. The guidance sign function is never compromised by battery failure, i.e., when the battery power is too low to meet photometric performance requirements.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENTS

Figure 1:
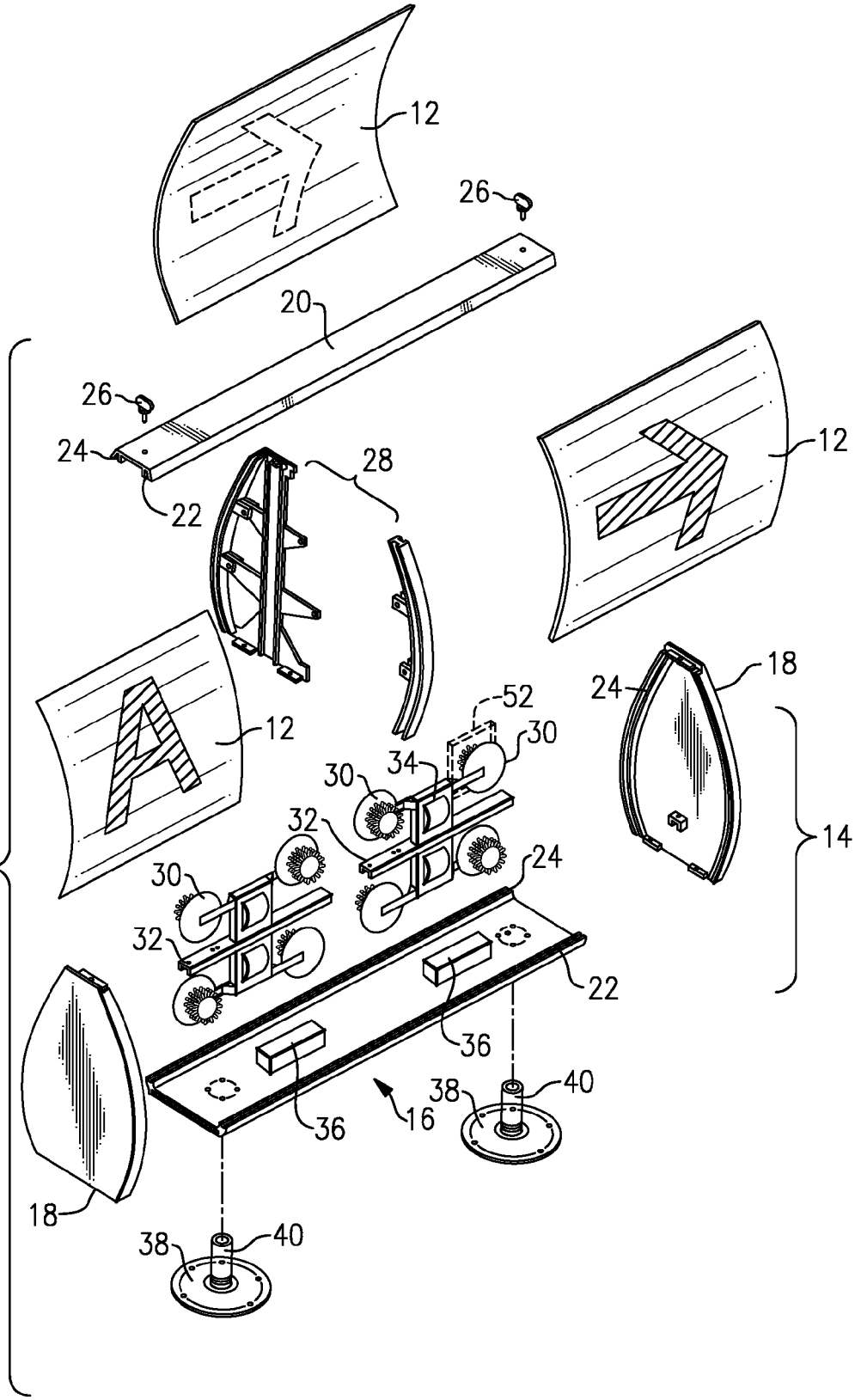
FIG. 1 is an exploded assembly view of a guidance sign according to one preferred embodiment of this invention.

With reference to the Drawing, and initially to FIG. 1, a curved-face airport guidance sign 10 of this invention is of the illuminated type, which has curved transparent or translucent legend panels 12 supported in a metal case or frame 14. The panels 12 may be formed from sheets or panels of a sturdy plastic material, i.e., a substrate such as acrylic, with a letter, number or symbol appearing on the outer surface. Other substrates, e.g., polycarbonate or a hybrid, could be used. These legend panels are used to identify a runway or taxiway, and/or to give directional information to assist the air crew in ground navigation. The size and visibility of the legends is governed by FAA directives. The inward side of each panel is coated with a reflective material, which assists in the internal reflecting of the incident light, the importance of which is discussed below.

Figure 2:
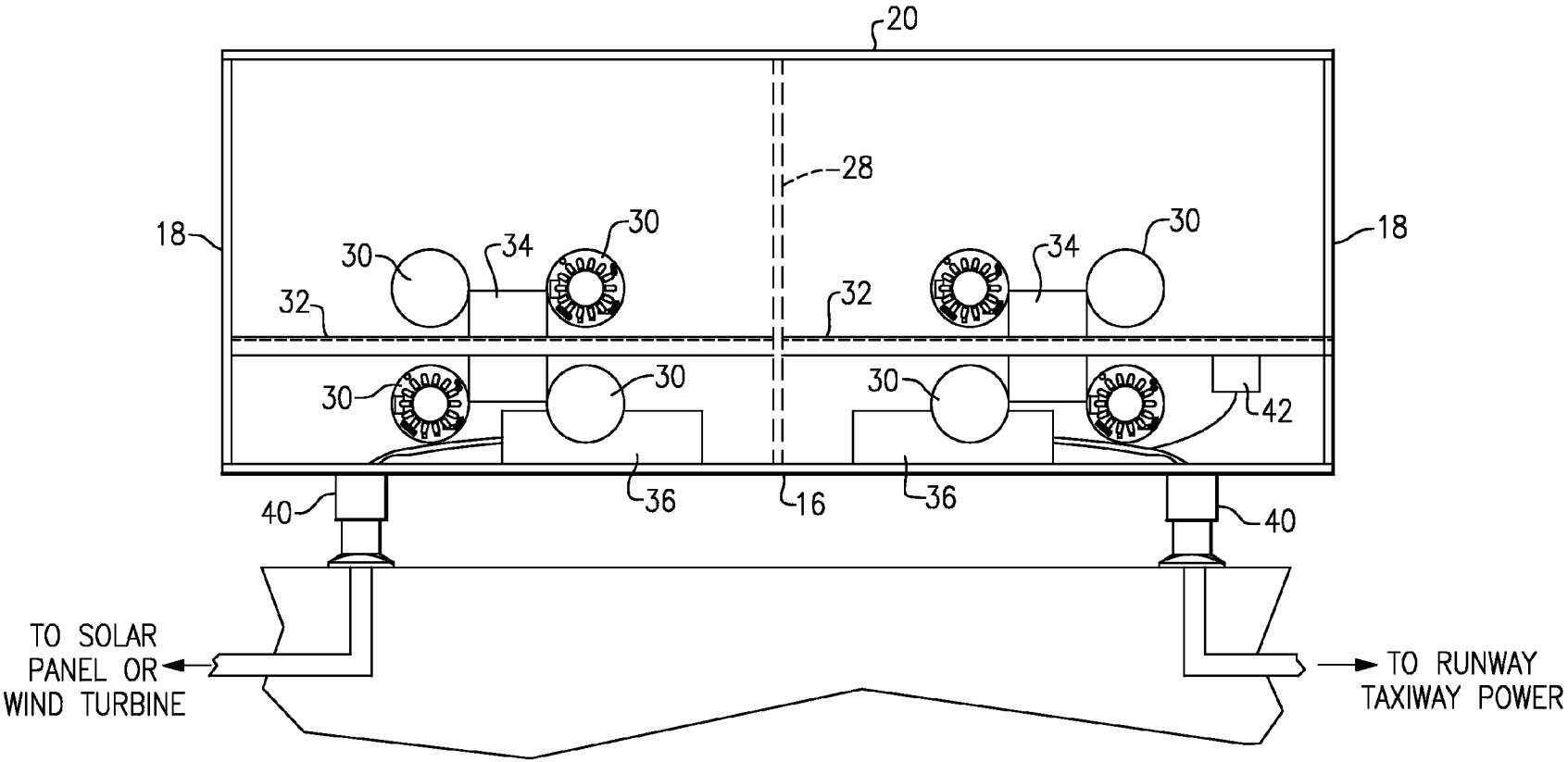
FIGS. 2 and 3 are front and side elevational views of this embodiment.

As shown in FIG. 2, the frame or case 14 has a flat floor or base member 16, side members or end panels 18, and a top cover 20, which fit together and retain the legend panels 12. In this case there are horizontal slots or recesses 22 on front and rear edges of the base member 16 and curved slots or recesses 24 on the rising edges of the end panels 18. There are similar slots or recesses in the top cover 20, but these are not visible in this view. The legend panels 12 are inserted into the frame so that the edges are held snugly in the slots 22 and 24, and then the cover 20 is installed at the top of the frame. Turn fasteners 26 secure the cover 20 to the tops of the end panels 18. While the curved legend panel design is preferred, the invention could be practiced in guidance signs that have flat panels. A multi-module insert 28, in the form of an open frame, is employed to accommodate two guidance sign legend panels 12 per side.

Within the frame 14, there are a plurality of LED based lamps 30, here arranged as two pairs of two lamps 30 per pair of legend panels 12. These LED lamps are supported on a lamp support channel 32 that extends transversely across the mid part of the guidance sign, and supports a power supply and control circuit device 34 for each set of lamps. In this embodiment, there is at least one storage battery 36, here a pair of storage batteries 36, situated on the base 16.

The frame 14 is supported above the ground surface, upon tubular legs, each with a floor flange 38 that mounts onto a ground surface, and a frangible coupling 40 of sufficient length to provide the required ground clearance, e.g., six inches, in the form of a metal tube or nipple provided with an annular cutout to weaken the coupling 40 sufficiently so that it will shear at a given stress level, e.g. if an aircraft strikes it or rolls over it, yet withstand the required wind load.

Figure 3:
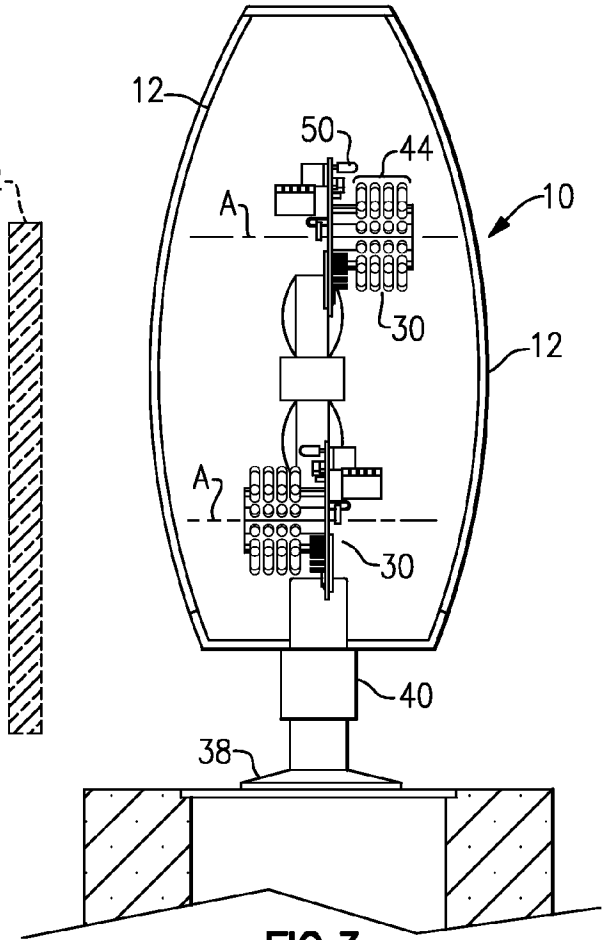

The runway or taxiway sign 10 is shown in a side elevation or profile in FIG. 2 and in an end view in FIG. 3. These views show a wiring that passes through in-ground conduit and upwards through each of the support legs or couplings 40, respectively. This permits recharging current from a solar panel or wind turbine generator (not shown) to pass into the guidance sign for charging up the storage batteries 36, and also shows conductors from the traditional runway/taxiway lighting power to pass through the other one of the couplings 40. This can be connected to the power supply and control circuit devices 34 and to the storage batteries 36. A switching circuit 42 is shown here, which is sensitive to the charge level on the storage battery or batteries, and serves to switch over from solar power to runway/taxiway power when needed. That is, the runway/taxiway power is directed to the LED lamps 30 when the stored energy on the batteries 36 is detected to be insufficient, and can be directed to the batteries 36 when the solar power voltage is insufficient for charging up the batteries. The switching circuit is also operable to turn on the guidance sign lamps 30, by sensing the circuit activity of the runway-taxiway power. When that power circuit is not active, the sign will not be lighted. When battery power is sufficient, this connection is used only to sense circuit activation. When the battery power is low, the operating current can come from the runway-taxiway power circuit. The wind turbine can be a low-profile device that does not interfere with airplane operations.

Figure 6:
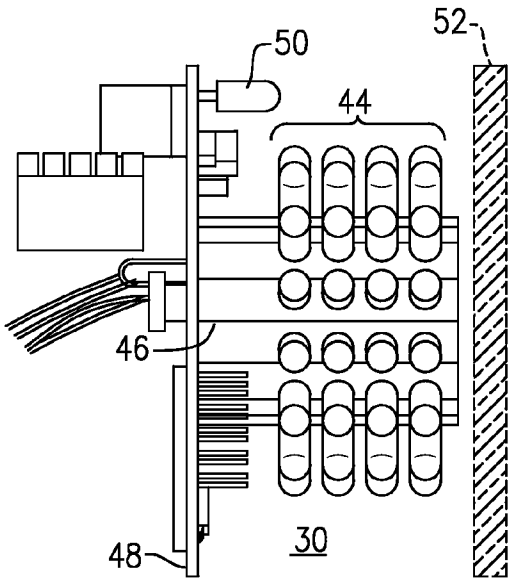
FIGS. 4, 5 and 6 are a perspective view of an LED lamp employed in this embodiment, an axial end view thereof, and a side elevation thereof, respectively.
Figure 4:
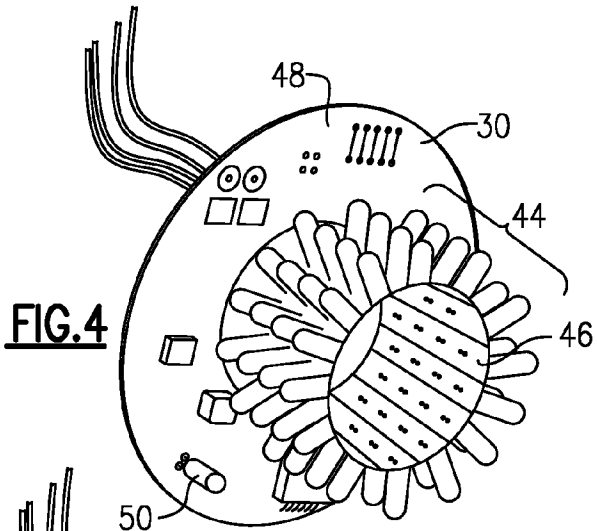
Figure 5:
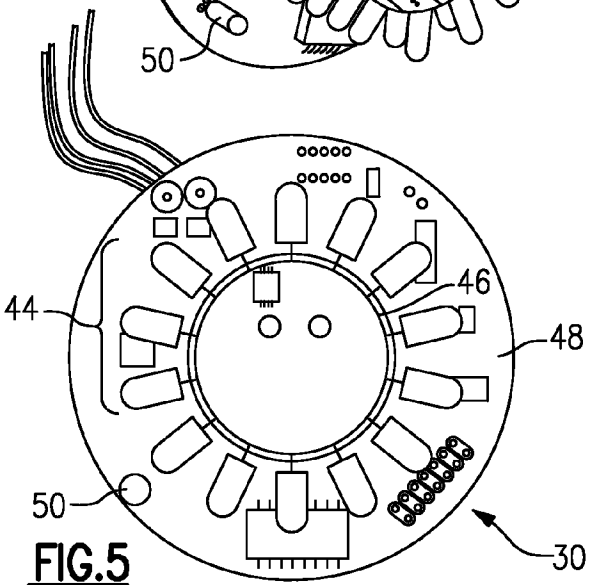

As shown in FIG. 3, and in more detail in FIGS. 4, 5, and 6, each of the LED based lamps 30 is formed of an array of white LEDs 44 which are mounted on a generally cylindrical turret 46. Here, the turret 46 is in the form of fourteen strips, each holding a row of four LEDs, such that each row is facing radially out at an angle. The angular spacing between rows is thus approximately 25.7 degrees. The generally cylindrical turret 36 has a main turret axis A, and the axis A for each lamp is situated horizontal and directed towards each of the associated pair of panels, as seen in FIG. 3. The light from the array of LEDs 44 beams up, down, sideways, but generally parallel to each of the panels, so that the light reflects off interior surfaces of the sign, at least once, and preferably numerous times, before passing through the legend panels 12. This action results in uniform and consistent lighting of each legend panel 12.

Each lamp device 30 has a main circuit board 48, with the turret 46 being mounted centrally on one side of the board 48. The board 48 holds various current control electronics, which will not be described in detail here. The board 48 is also used to mount the lamp device 30 on the support channel 32. The lamps 30 are mounted, between each pair of legend panels 12, with two lamps above the support channel, and two beneath, and with the turrets 46 thereof oriented to one side and the other alternately, as shown.

Each lamp device 30 has its array of LEDs grouped into a plurality of groups of individual LEDs, with the LEDs of each group on different strips of the turret 46, so that the LEDs of that group are at different angular positions. In the preferred embodiment as shown, the array 44 includes fifty-six individual LEDs, arranged as fourteen groups of four LEDs per group. The successive LEDs of each group are located at successive angular positions. In this fashion, if there is a failure of any given group, the dark or unlit LEDs will be distributed at different locations around the turret, and the failure of that group will not result in unevenness of lighting. In practice the lamp 30 can lose up to three groups of four LEDs without needing to be taken out of service. The circuitry on the lamp includes a provision to cause the entire lamp to go dark if there are four or more groups (i.e., sixteen LEDs) that fail, which is 25% of the array 44. There is an additional or auxiliary LED 50 positioned on the circuit board 48 apart from the turret 46. This may be a distinct color, e.g., red, and this LED glows when there is a failure among any of the groups of LEDs of the array 44. The red LED makes if possible for the service technician to identify which of the lamps 30 may need service or replacement.

In this embodiment, the array of LEDs uses the so-called white LEDs, which emit light over the visible spectrum. In some cases, the LEDs may have more light in some wavelengths than others, and in some alternative embodiments the lamps may employ a mix of red, green and blue LEDs to achieve the effect of white light. The term LED as used here should be interpreted to cover solid state light emitting devices, including not only light emitting diodes but also solid state laser devices or other illuminating devices of that general type.

As shown in FIG. 6, there can be an optional diffusion plate 52 mounted on the axis of the turret 46 at the end remote from the circuit board. The diffusion plate 52 can be of a standard translucent or frosted material, e.g., plastic of a type used in road signs. The diffusion plate can be used in larger signs to prevent rings of light from appearing on the legend panels 12.

A main advantage of the guidance sign of this invention with solid state based illumination is the inherent low power draw, long life, and low maintenance of such devices. Also, because of the array of LEDs of these lamps being oriented in planes that are generally parallel to the legend panels, the beams of light undergo multiple reflections on surfaces inside the sign, including the reflective interior surfaces of the frame and the reflective inside surfaces of the legend panels, which results in high diffusion, with extremely even lighting and without hot spots or dark spots.

While the invention has been described in detail with respect to a preferred embodiment, it should be recognized that there are many alternative embodiments that would become apparent to persons of skill in the art. Many modifications and variations are possible which would not depart from the scope and spirit of this invention, as defined in the appended claims.

I claim:

1. In an illuminated airport guidance sign for the type that includes a pair of rectangular translucent or transparent legend panels each formed of a generally rectangular sheet of a sturdy rigid translucent or transparent material; a sign frame supporting the pair of legend panels in symmetric oppositely facing orientations, the frame having a base closing off a bottom of the sign; a top cover that closes off a top of the sign; end portions that close off ends of the sign; a plurality of lamps supported within the sign between said pair of legend panels, each said lamp having a generally horizontal lamp axis; support means within said sign frame on which said lamps are mounted, each said lamp being mounted on said support means such that its axis is horizontal and disposed towards each of said pair of legend panels; electrical power means for providing electrical power to said lamps so as to produce even illumination from said lamps; support legs supporting the base of said sign upon a support surface alongside a runway or taxiway; and the improvement in which each of said lamps is formed as an array of white LEDs supported on a cylindrical turret, the turret having its axis disposed on said lamp axis with all of the LEDs all being disposed in a radial direction only relative to said lamp axis to emit respectively in directions that are radial only in respect to the axis of the cylindrical turret, and with no LEDs emitting in a direction towards either of said legend panels, such that substantially all the LEDs emit beams of light in directions that are generally parallel to said legend panels, so that the all the light from said LEDs reflects off at least one interior surface of the frame of the sign before being incident upon either of said legend panels, and none of the LEDs of said lamp have their beams oriented directly at either of said legend panels.

2. The illuminated airport guidance sign of claim 1, wherein said legend panels each are formed of a transparent or translucent sheet having an interior surface that has a reflective coating.

3. The illuminated airport guidance sign of claim 1, wherein said frame has a highly reflective coating on its interior.

4. The illuminated airport guidance sign of claim 1, wherein each of said lamps is formed with a flat circuit board, and said turret is disposed on one side of said circuit board.

5. The illuminated airport guidance sign of claim 4, wherein array of LEDs on said turret is arranged as a plurality of axial rows of LEDs, with the rows being arranged at successive angles around the axis of the turret.

6. The illuminated airport guidance sign of claim 5, wherein said array of LEDs are electrically connected in groups of LEDs in which each LED of each group is in a different row, so that in the case of a failure of a group in which the LEDs thereof go dark, the LEDs of that group are distributed at different angular positions about the axis of the turret.

7. The illuminated airport guidance sign of claim 5, comprising means for shutting off the power to the entire array of LEDs when a predetermined plurality of said groups of LEDs fails.

8. The illuminated airport guidance sign of claim 4, comprising an auxiliary LED mounted upon said circuit board, and means for illuminating said auxiliary LED when some or all of said LEDs of said array fail.

9. The illuminated airport guidance sign of claim 4, comprising a diffusion plate mounted on an axis of said turret on the side thereof remote from said circuit board.

10. The illuminated airport guidance sign of claim 1, wherein said electrical power means includes a storage battery within the frame and including means for providing electrical power to said lamps from said storage battery.

11. The illuminated airport guidance sign of claim 10, comprising a solar panel disposed outside the sign, and means coupling the solar panel to said storage battery for charging the same during daylight hours.

12. The illuminated airport guidance sign of claim 10, comprising a wind-turbine generator disposed outside the sign, and means coupling the generator to said storage battery for charging the same during times there is sufficient wind.

13. The illuminated airport guidance sign of claim 10, comprising means carrying runway-taxiway power to the electrical power means within said guidance sign; and means for detecting the amount of electrical charge on said storage battery, and switching from said battery to said runway-taxiway power when detected the electrical charge on said battery is below a predetermined threshold.

14. The illuminated airport guidance sign of claim 1, (a) wherein said support means includes one or more support channels positioned between the legend panels of said pair of legend panels; and (b) wherein said plurality of lamps includes a first lamp and a second lamp both mounted on said one or more support channels with the turret of the first lamp being oriented towards one of said legend panels and the turret of the second lamp being oriented in an opposite direction towards the other said legend panel.

15. The illuminated airport guidance sign of claim 14, (c) wherein said plurality of lamps includes a third lamp and a fourth lamp both mounted on another of said one or more support channels, such that the first lamp is positioned directly above said fourth lamp and said second lamp is positioned directly above said third lamp, with said first and third lamps having their axes directed towards one of said legend panels and said second and fourth lamps both having their axes oriented in an opposite direction towards the other of said legend panels.

16. In an illuminated airport guidance sign for the type that includes a pair of rectangular translucent or transparent legend panels each formed of a generally rectangular sheet of a sturdy rigid translucent or transparent material; a sign frame supporting the pair of legend panels in symmetric oppositely facing orientations, the frame having a base closing off a bottom of the sign; a top cover that closes off a top of the sign; end portions that close off ends of the sign; a plurality of lamps supported within the sign between said pair of legend panels, each said lamp having a generally horizontal lamp axis; support means within said sign frame on which said lamps are mounted, each said lamp being mounted on said support means such that its axis is horizontal and disposed towards each of said pair of legend panels; electrical power means for providing electrical power to said lamps so as to produce even illumination from said lamps; support legs supporting the base of said sign upon a support surface alongside a runway or taxiway; and the improvement in which each of said lamps is formed as an array of white LEDs supported on a cylindrical turret, the turret having its axis disposed on said lamp axis with all of the LEDs all being disposed in a radial direction only relative to said lamp axis to emit respectively in directions that are radial only in respect to the axis of the cylindrical turret, and with no LEDs emitting in a direction towards either of said legend panels, such that substantially all the LEDs emit beams of light in directions that are generally parallel to said legend panels, so that the all the light from said LEDs reflects off at least one interior surface of the frame of the sign before being incident upon either of said legend panels, and none of the LEDs of said lamp have their beams oriented directly at either of said legend panels; and wherein said support means within the frame of the guidance sign supports two pairs of said lamps, with one pair having its lamp axes facing one said legend panel and the other pair having its lamp axes facing the other legend panel.

17. The illuminated airport guidance sign of claim 16, wherein each of said lamps is formed with a flat circuit board, said turret is disposed on one side of said circuit board, and wherein each said lamp has a translucent diffusion plate mounted at the axis of said turret at a side thereof remote from said flat circuit board, and between said turret and an associated one of said legend panels.

18. In an illuminated airport guidance sign for the type that includes a pair of rectangular translucent or transparent legend panels each formed of a generally rectangular sheet of a sturdy rigid translucent or transparent material; a sign frame supporting the pair of legend panels in symmetric oppositely facing orientations, the frame having a base closing off a bottom of the sign; a top cover that closes off a top of the sign; end portions that close off ends of the sign; a plurality of lamps supported within the sign between said pair of legend panels, each said lamp having a generally horizontal lamp axis; support means within said sign frame on which said lamps are mounted, each said lamp being mounted on said support means such that its axis is horizontal and disposed towards each of said pair of legend panels; electrical power means for providing electrical power to said lamps so as to produce even illumination from said lamps; support legs supporting the base of said sign upon a support surface alongside a runway or taxiway; and the improvement in which each of said lamps is formed as an array of white LEDs supported on a cylindrical turret, the turret having its axis disposed on said lamp axis with all of the LEDs all being disposed in a radial direction only relative to said lamp axis to emit respectively in directions that are radial only in respect to the axis of the cylindrical turret, and with no LEDs emitting in a direction towards either of said legend panels, such that substantially all the LEDs emit beams of light in directions that are generally parallel to said legend panels, so that the all the light from said LEDs reflects off at least one interior surface of the frame of the sign before being incident upon either of said legend panels, and none of the LEDs of said lamp have their beams oriented directly at either of said legend panels; wherein said support means includes a support channel positioned between the legend panels of said pair of legend panels; and said plurality of lamps includes first, second, third, and fourth LED lamps, with the support channel holding said first and second LED lamps above the support channel and holding the third and fourth LED lamps below the support channel, with said first and third LED lamps having their turrets oriented towards one of said legend panels and said second and fourth LEDs having their turrets oriented in an opposite direction towards the other of said legend panels.

* * * * *